US010921076B1

(12) United States Patent
Thomas et al.

(10) Patent No.: US 10,921,076 B1
(45) Date of Patent: Feb. 16, 2021

(54) MAGWELL ADAPTER WITH SEAR SPRING ATTACHMENT MECHANISM

(71) Applicant: Nighthawk Custom LLC, Berryville, AR (US)

(72) Inventors: Daniel Thomas, Harrison, AR (US); Allen Wyatt, Berryville, AR (US); Jesse Lipke, Berryville, AR (US)

(73) Assignee: NIGHTHAWK CUSTOM LLC, Berryville, AZ (US)

( * ) Notice: Subject to any disclaimer, the term of this patent is extended or adjusted under 35 U.S.C. 154(b) by 0 days.

(21) Appl. No.: 16/580,121

(22) Filed: Sep. 24, 2019

Related U.S. Application Data

(60) Provisional application No. 62/741,252, filed on Oct. 4, 2018.

(51) Int. Cl.
*F41C 23/10* (2006.01)
*F41A 9/82* (2006.01)

(52) U.S. Cl.
CPC ..... *F41A 9/82* (2013.01); *F41C 23/10* (2013.01)

(58) Field of Classification Search
CPC .... F41A 9/24; F41A 9/54; F41A 35/00; F41C 23/10
USPC ..... 42/85; 89/33.1
See application file for complete search history.

(56) References Cited

U.S. PATENT DOCUMENTS 2,324,125 A * 7/1943 Van Horn ..... F41A 19/46 89/141
2,372,519 A * 3/1945 Roper ..... F41A 17/36 89/137
3,683,537 A * 8/1972 Silva ..... F41A 19/16 42/69.01
3,722,358 A * 3/1973 Seecamp ..... F41A 19/48 89/147
3,999,321 A * 12/1976 Musgrave ..... F41C 23/10 42/71.02
4,520,585 A * 6/1985 Barrett ..... F41C 23/10 42/7
4,570,370 A * 2/1986 Smith ..... F41C 23/10 42/7
5,052,140 A * 10/1991 Smith ..... F41C 23/10 42/7
5,086,579 A * 2/1992 Flatley ..... F41A 17/74 42/69.03
5,621,995 A * 4/1997 Smith ..... F41A 9/65 42/50

(Continued)

*Primary Examiner* — Derrick R Morgan
(74) *Attorney, Agent, or Firm* — Eversheds Sutherland (US) LLP

(57) ABSTRACT

A magwell adapter is provided for use with a firearm. The firearm can include a firearm frame having a barrel section and a grip section. The grip section of the firearm can include a sear spring alignment plate, a magazine well, a sear spring, and a main spring cavity. The magwell adapter can be slidably coupled to the bottom end of the grip section of the firearm or coupled in another manner. The magwell adapter can include an aperture for receiving a tab of and holding the sear spring in place within the grip section. The magwell adapter can also include one or more pin receiving apertures adjacent to a rear end of the adapter. The pin receiving apertures can be configured to receive a mainspring housing pin to couple the mainspring housing to the magwell adapter when the mainspring housing is inserted into the grip section of the firearm.

16 Claims, 16 Drawing Sheets

(56) References Cited

U.S. PATENT DOCUMENTS

| | | | | | |
|---|---|---|---|---|---|
| 5,761,842 | A * | 6/1998 | Mantymaa | F41C 23/12 | 42/71.02 |
| 6,164,001 | A * | 12/2000 | Lee | F41A 19/10 | 42/69.01 |
| 6,412,206 | B1 * | 7/2002 | Strayer | F41A 19/12 | 42/69.03 |
| D529,983 | S * | 10/2006 | Yu | D22/108 | |
| 7,743,542 | B1 * | 6/2010 | Novak | F41C 23/10 | 42/7 |
| 8,490,311 | B2 * | 7/2013 | Hogue | F41C 23/10 | 42/71.01 |
| D798,983 | S * | 10/2017 | Chen | D22/108 | |
| D808,491 | S * | 1/2018 | Chen | D22/108 | |
| D808,492 | S * | 1/2018 | Chen | D22/108 | |
| 10,066,885 | B2 * | 9/2018 | Chen | F41A 9/59 | |
| 10,101,105 | B1 * | 10/2018 | Novak | F41A 35/00 | |
| 10,203,177 | B2 * | 2/2019 | Chavez | F41C 23/10 | |
| 10,415,919 | B1 * | 9/2019 | Harrigan | F41A 21/48 | |
| 2002/0104248 | A1 * | 8/2002 | Szabo | F41C 3/00 | 42/70.01 |
| 2006/0130386 | A1 * | 6/2006 | Pikielny | F41C 23/10 | 42/85 |
| 2008/0163531 | A1 * | 7/2008 | Zukowski | F41A 17/46 | 42/21 |
| 2010/0132238 | A1 * | 6/2010 | Werner | F41C 23/10 | 42/71.02 |
| 2013/0139426 | A1 * | 6/2013 | Baxley | F41C 23/10 | 42/71.02 |
| 2017/0205188 | A1 * | 7/2017 | Chavez | F41C 23/10 | |
| 2017/0356710 | A1 * | 12/2017 | Full | F41A 11/04 | |
| 2019/0107363 | A1 * | 4/2019 | Harrigan | F41A 5/02 | |
| 2020/0025472 | A1 * | 1/2020 | Landis | F41A 9/65 | |

* cited by examiner

MAGWELL ADAPTER WITH SEAR SPRING ATTACHMENT MECHANISM

RELATED APPLICATIONS

This application claims priority under 35 U.S.C. § 119 to U.S. Provisional Patent Application No. 62/741,252 filed Oct. 4, 2018, and titled "MAGWELL ADAPTER WITH SEAR SPRING ATTACHMENT MECHANISM," the entire contents of which are hereby incorporated herein by reference for all purposes.

TECHNICAL FIELD

The present disclosure is generally directed to firearms, and more particularly to a magwell adapter configured to be attached to a firearm frame and including a sear spring attachment mechanism.

BACKGROUND

Conventional firearm magazines can be inserted into a firearm via a magazine well or magwell, which typically has an opening that extends to the bottom side of the firearm. Magwells are often designed with strict tolerances in relation to the appropriate magazine, such that the magazine must be carefully aligned with the magwell opening before the magazine may be inserted, making it difficult to replace the magazine quickly. To improve the ease of inserting magazines into the magwell of a firearm, magazine well adapters or magwell adapters have been constructed that attach to a firearm and provide an enlarged opening and a curved or angular shape that assists the user with inserting the magazine into the magwell of the firearm. These conventional magwell adapters are an add-on feature to the firearm.

Conventional components of the firearm, such as sear springs and main spring housings, are not attached to the magwell adapter so that users can remove the adapters when they do not want to use them with the firearm. FIG. 1 is a perspective view of a portion of a conventional firearm 100. The conventional firearm can include a firearm frame 105. The firearm frame includes a barrel section 106 and a grip section 107. The conventional magwell adapter is typically coupled to the firearm frame along a bottom end of the grip section 107. The grip section 107 also includes a sear spring alignment plate 110. The sear spring alignment plate 110 includes an attachment slot for attaching a sear spring (see FIG. 5) to the alignment plate 110.

Recently, the desire and demand to legally conceal firearms on one's person (i.e., concealed carry) for the purposes of protection has increased. As more people have sought to purchase firearms for concealed carry purposes, the overall size of the firearm has been identified as a main issue preventing easy or comfortable concealment. In order to improve the comfort and ability to conceal the firearms, manufacturers have attempted to reduce the overall size of the firearm. These attempts include reducing the length of the barrel section 106 of the firearm 100 and reducing the length of the grip section 107 of the firearm. However, manufactures have been limited in their ability to reduce the length of the grip section due to the additional components, including the sear spring and the main spring housing, that are attached and/or inserted into the grip section 107 and the desire to use standard, off-the-shelf components rather than requiring a complete redesign of multiple components of the firearm. For example, reducing the length of the grip section to a length that is less than where the attachment slot 115 for the sear spring is located will prevent attachment of the sear spring to the firearm 100 and render the firearm inoperable. Further, reducing the length of the grip section 107 in this manner can also prevent the main spring housing from being coupled to the firearm.

BRIEF DESCRIPTION OF THE SEVERAL VIEWS OF THE DRAWINGS

For a more complete understanding of the present disclosure and certain features thereof, reference is now made to the following description, in conjunction with the accompanying figures briefly described as follows.

DETAILED DESCRIPTION OF THE EXAMPLE EMBODIMENTS

Figure 1:
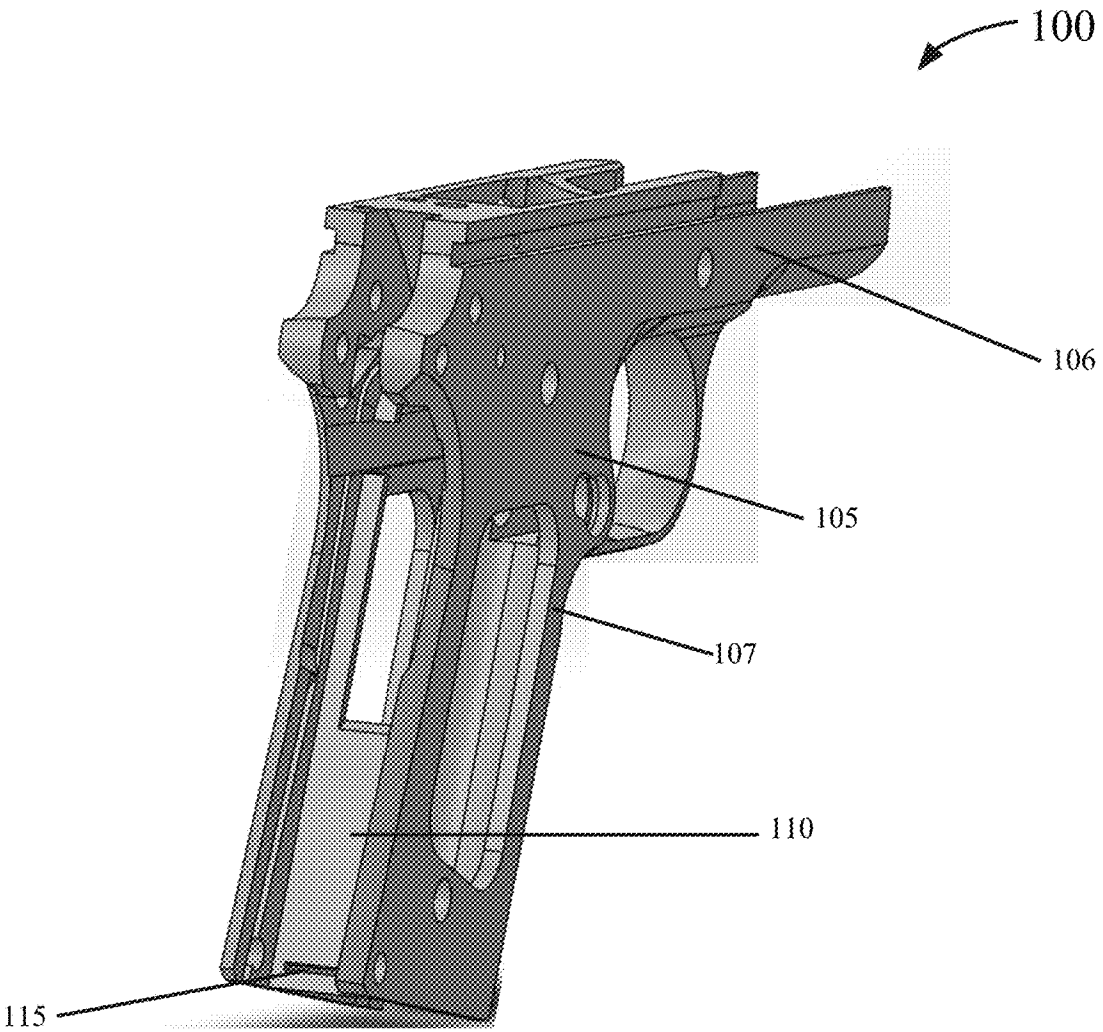
Figure 1 (Prior Art)
FIG. 1 is a perspective view of a portion of a conventional firearm.
Figure 2A:
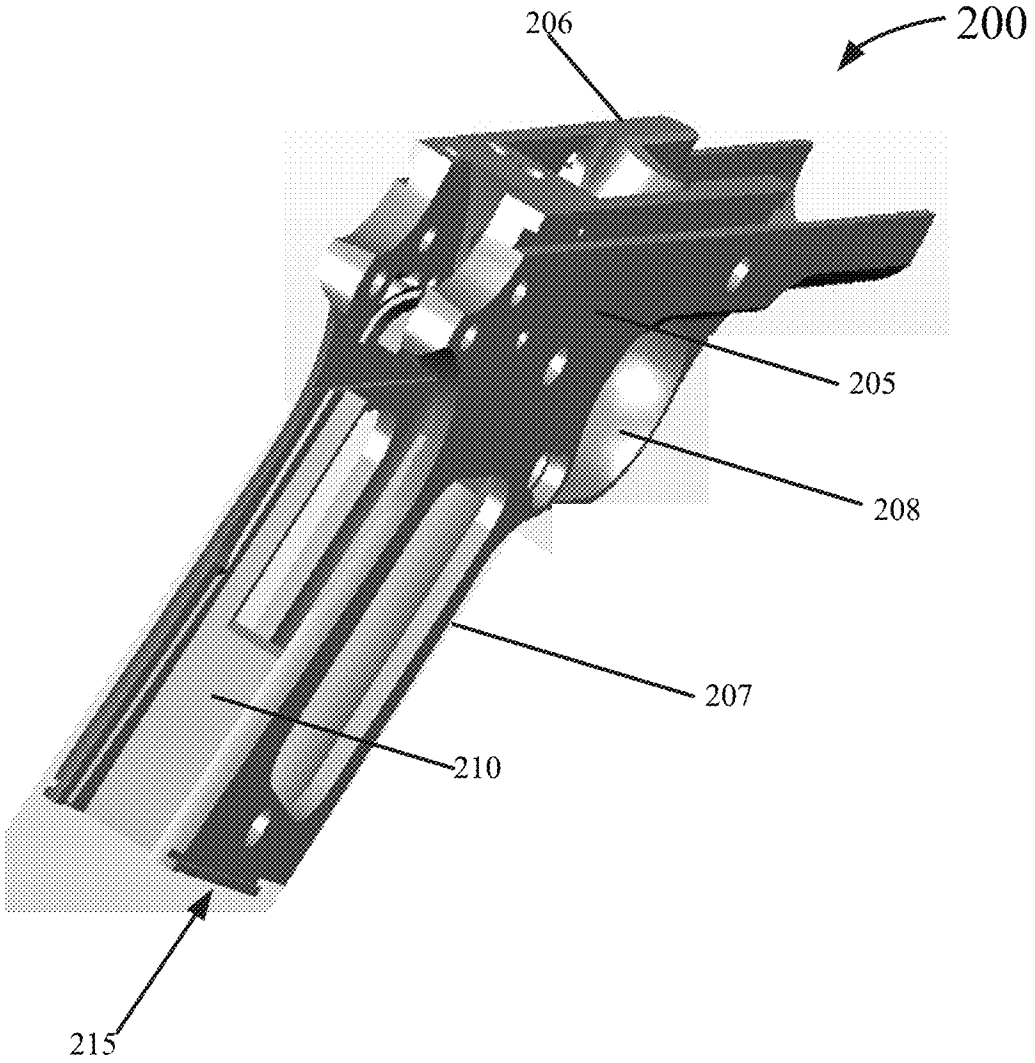
FIGS. 2A-2D are various views of a firearm frame, in accordance with one example embodiment of the disclosure.
Figure 2D:
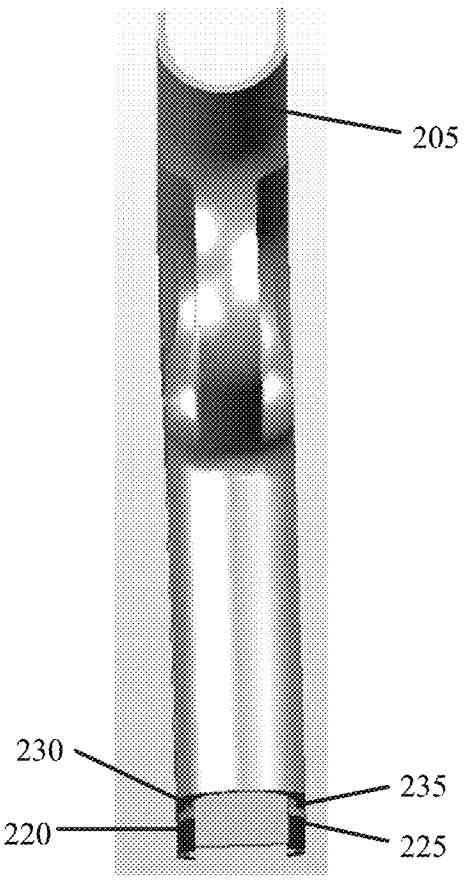
Figure 2C:
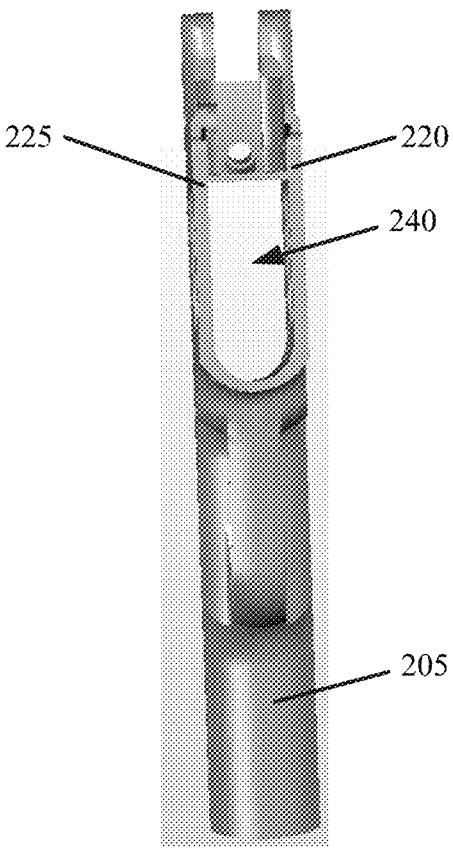
Figure 2B:
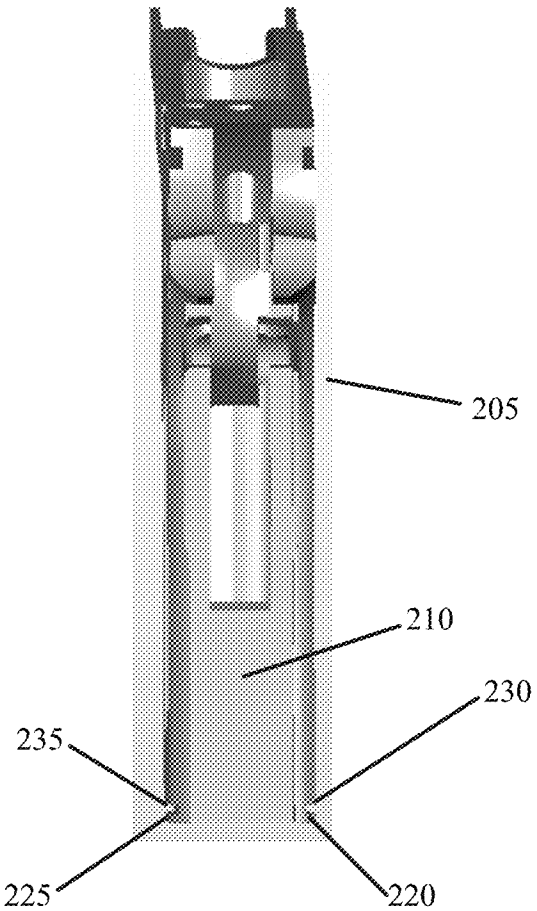
Figure 3A:
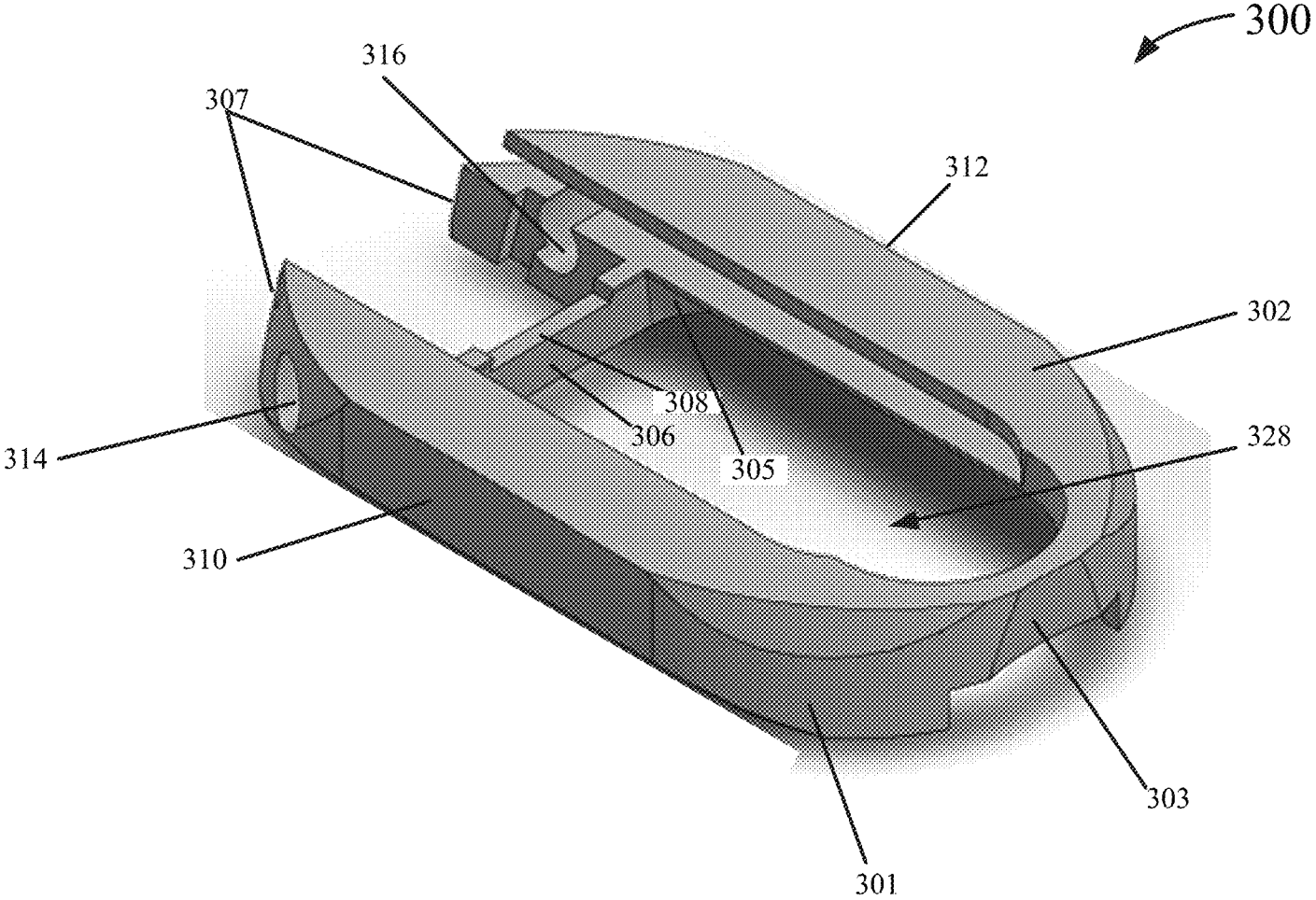
FIGS. 3A-3D are various views of a magwell adapter with sear spring aperture, in accordance with one example embodiment of the disclosure.
Figure 3B:
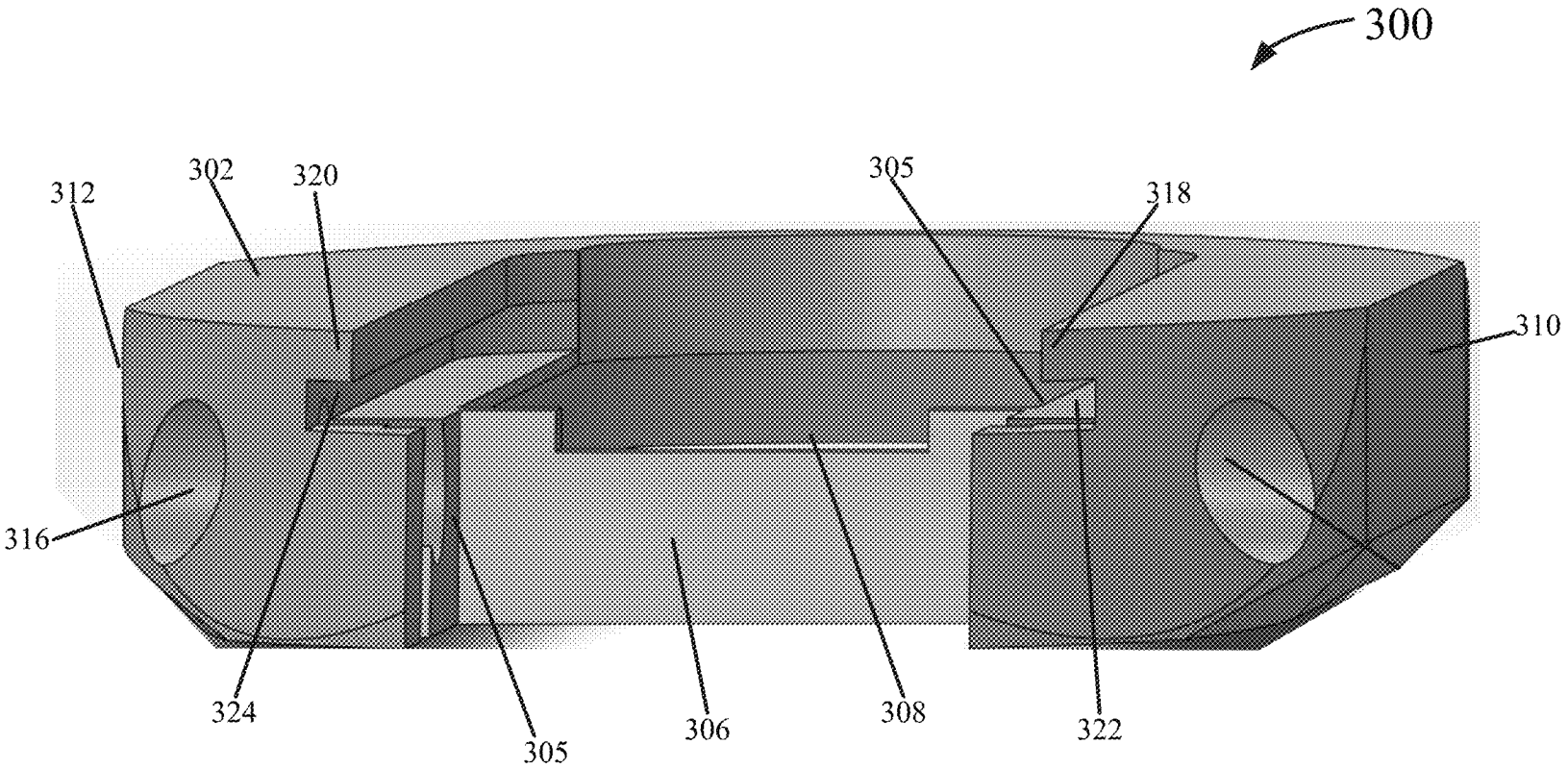
Figure 3C:
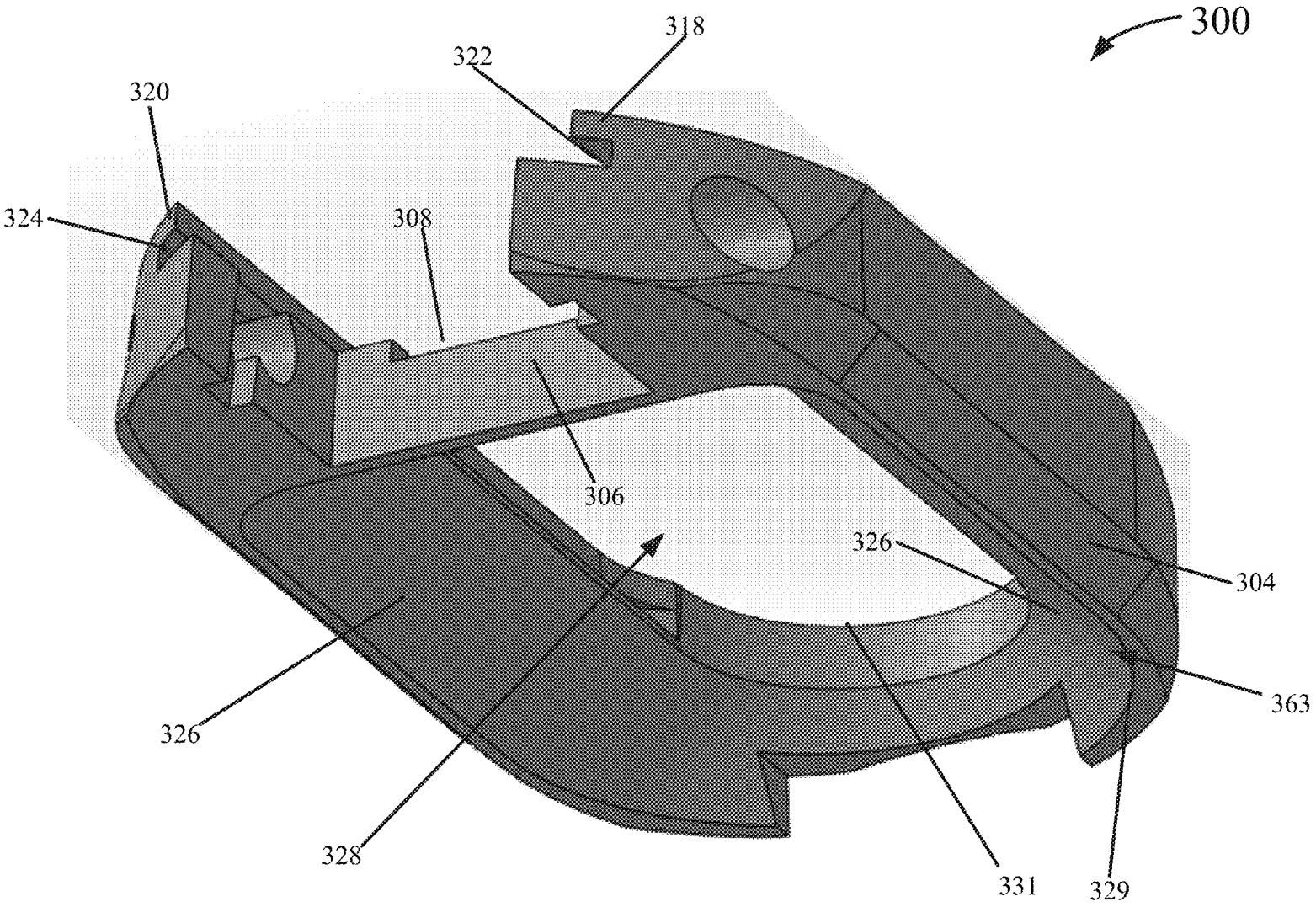
Figure 3D:
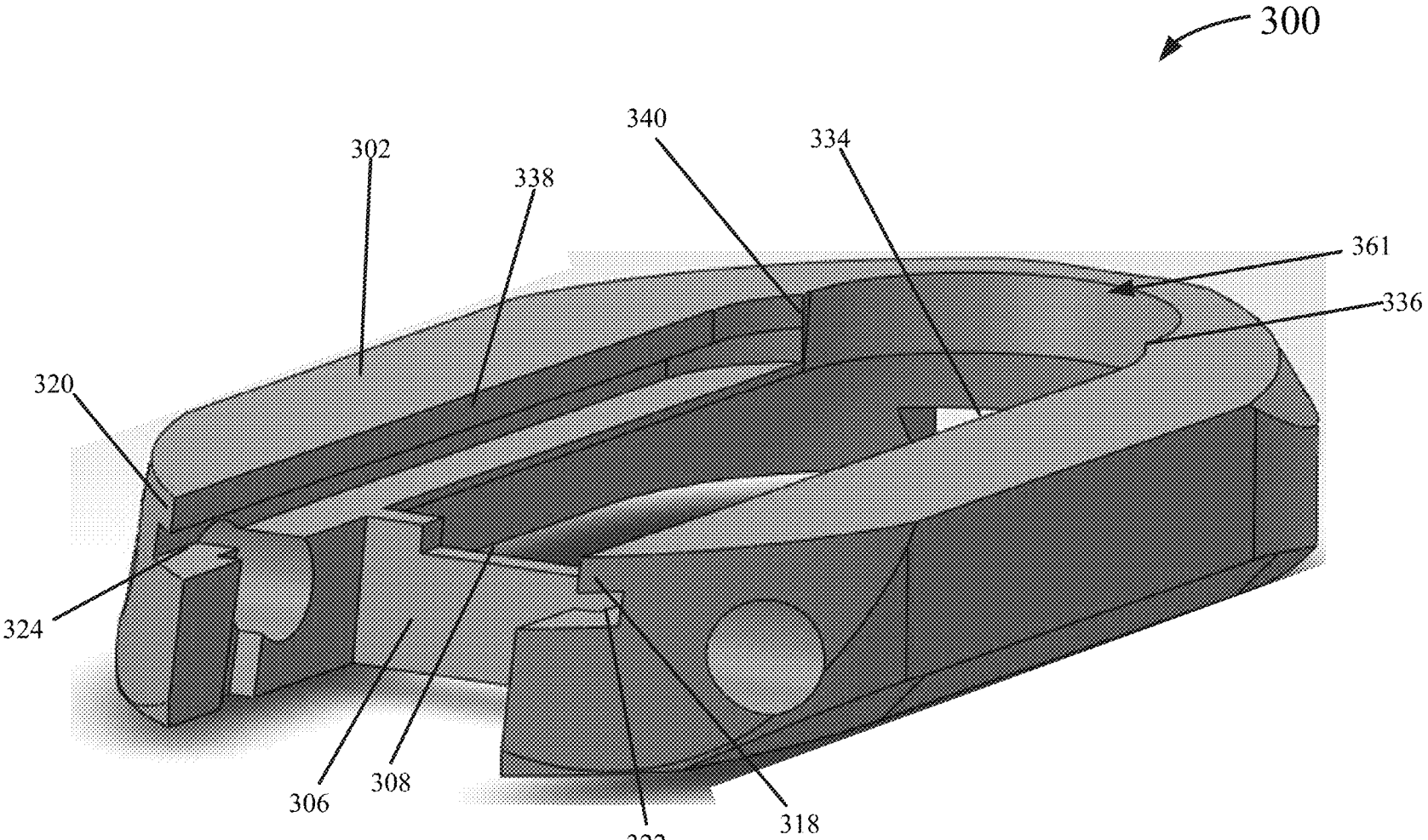

Example embodiments now will be described more fully hereinafter with reference to the accompanying drawings, in which example embodiments are shown. The concepts claimed and described herein may, however, be embodied in many different forms and should not be construed as limited to the example embodiments set forth herein; rather, these embodiments are provided so that this disclosure will be thorough and complete, and will fully convey the scope of the claims to those skilled in the art. Like numbers refer to like, but not necessarily the same, elements throughout.

Certain dimensions and features of the example firearm and/or magwell adapter are described herein using the term "approximately." As used herein, the term "approximately" indicates that each of the described dimensions is not a strict boundary or parameter and does not exclude functionally similar variations therefrom. Unless context or the description indicates otherwise, the use of the term "approximately" in connection with a numerical parameter indicates that the numerical parameter includes variations that, using mathematical and industrial principles accepted in the art (e.g., rounding, measurement or other systematic errors, manufacturing tolerances, etc.), would not vary the least significant digit.

In addition, certain relationships are described herein using the term "substantially." As used herein, the terms "substantially" and "substantially equal" indicates that the equal relationship is not a strict relationship and does not exclude functionally similar variations therefrom. Unless context or the description indicates otherwise, the use of the term "substantially" or "substantially equal" in connection with two or more described dimensions or elements indicates that the equal relationship between the dimensions or elements includes variations that, using mathematical and industrial principles accepted in the art (e.g., rounding, measurement or other systematic errors, manufacturing tolerances, etc.), would not vary the least significant digit of the dimensions or elements. As used herein, the term "substantially constant" indicates that the constant relationship is not a strict relationship and does not exclude functionally similar variations therefrom. As used herein, the term "substantially parallel" indicates that the parallel relationship is not a strict relationship and does not exclude functionally similar variations therefrom. As used herein, the term "substantially orthogonal" or "substantially perpendicular" indicates that the orthogonal relationship is not a strict relationship and does not exclude functionally similar variations therefrom It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

FIGS. 2A-2D are various views of a firearm 200, in accordance with one example embodiment of the disclosure. Now referring to FIGS. 2A-2D, the example firearm 200 can be a pistol. In other example embodiments, the firearm can be any other type of firearm known to those of ordinary skill in the art. The firearm 205 can include a firearm frame 205. The firearm frame 205 can be constructed of one or more pieces and can be made from metal, plastic, composite, or any combination thereof. The firearm frame 205 can include a barrel section 206, a grip section 207, and a trigger guard 208. Other components known to those of ordinary skill in the art can be constructed with or coupled to the firearm frame 205 to create a completed firearm 200. Such components have not been shown herein in order to better show the relevant portions of the concept described herein. However, each is considered part of the firearm 200 and those of ordinary skill in the art would be capable of selecting the additional components and constructing the firearm 200.

The grip section 207 is configured to be gripped by a user with the user's hand when holding and discharging the firearm 200. The grip section 207 can include a sear spring alignment plate 210 positioned between and generally extending from the opposing lateral sides of the grip section 207. In one example, the sear spring alignment plate 210 can be a planar or substantially planar member that includes at least one opening near the top end of the sear spring alignment plate 210. The sear spring alignment plate 210 can extend from a bottom end of the grip section 207 towards the top end of the grip section 207. In certain example embodiments, the bottom end of the sear spring alignment plate can be horizontal or substantially horizontal and disposed along a level plane.

The grip section 207 can also include a magwell attachment mechanism 215. A magwell adapter (discussed hereinafter) is configured to be attached to the bottom end of the grip section 207 using the magwell attachment mechanism 215. While one example embodiment of a magwell attachment mechanism 215 will be described herein, that description is not intended to be limiting, as there are a number of ways known in the art for attaching the magwell adapter to the grip section 207, each of which is considered part of this disclosure and able to be used with the concepts described herein. In one example embodiment, the magwell attachment mechanism 215 can be positioned along the bottom end of the grip section 207. The example magwell attachment mechanism 215 can include a first tab 220 disposed along a first lateral side of the grip section 207 and extending laterally outward therefrom and a second tab 225 disposed along an opposing second lateral side of the grip section 207 and extending laterally outward therefrom. The magwell attachment mechanism 215 can also include a first slot 230 disposed along the first lateral side of the grip section 207 and extending laterally inward therefrom. The first slot 230 can be positioned directly above the first tab 220. In certain example embodiments, the first slot 230 in the grip section 207 can create or define the first tab 220. The magwell attachment mechanism 215 can also include a second slot 235 disposed along the second lateral side of the grip section 207 and extending laterally inward therefrom. The second slot 235 can be positioned directly above the second tab 225. In certain example embodiments, the second slot 235 in the grip section 207 can create or define the second tab 225. Each of the first tab 220, first slot 230, second tab 225, and second slot 235 can extend from the back edge or substantially the back edge of the grip section 207 toward the front side of the grip section 207. In one example, the first tab 220 and the second tab 225 can be a single unitary tab that extends from the first lateral side to the second lateral side of the grip section 207. Similarly, in one example embodiment, the first slot 230 and second slot 235 can be a single unitary slot that extends from the first lateral side to the second lateral side of the grip section. In this example embodiment, the single unitary slot in the grip section 207 can create or define the first tab 220 and second tab 225 either separately or as a single unitary tab.

The grip section 207 can also include a magazine well 240. The magazine well 240 can include an opening in a portion of the bottom side of the grip section 207. In one example, the magazine well 240 can be defined by all or at least a portion of the interior of the side walls of the grip section 207 and the sear spring alignment plate 210. The magazine well 240 is configured to receive a magazine therein.

FIGS. 3A-3D are various views of a magwell adapter 300, in accordance with one example embodiment of the disclosure. While one example form of the magwell adapter 300 is shown and described with regard to FIGS. 3A-3D, this form is for example purposes only, as magwell adapters can have many different shapes and sizes, each of which is considered to be within the scope and spirit of this disclosure. Further, certain design features of the magwell adapter 300 are described below. However, these features are also for example purposes only. The magwell adapter 300 may have fewer or additional features or the modification of some of those features described herein and still be within the scope and spirit of this disclosure. The magwell adapter 300 is configured to be removably coupled to the grip section 207 of firearm 200 via the magwell attachment mechanism 215. The connection features of the magwell adapter 300 shown and described with reference to FIGS. 3A-3D are for example purposes only, as a number of other connection methodologies may be used. Each of those other connection methodologies and features is considered to be within the scope and spirit of this disclosure.

Referring now to FIGS. 2A-3D, the magwell adapter 300 is configured to make it easier to insert a magazine into the magazine well 240 of the firearm 200. The magwell adapter 300 can include an outer body frame 301 (e.g., an outer member or series of members coupled to one another)

having a top surface 302, an opposing bottom surface 304, a front end 303 and an opposing rear end 307. The top surface 302 of the outer body frame 301 has a first inner edge 331 that defines a first aperture 361 and the bottom surface 304 of the outer frame 301 has a second inner edge 329 that defines a second aperture 363 that has a surface area that is greater than the surface area defined by the first aperture 361. In certain example embodiments, the top surface 302 of the outer frame 301 can be planar or substantially planar in order to matingly engage the bottom end of the grip section 207. In other embodiments, the top surface 302 can have any other shape or mix of shapes. In certain example embodiments, at least a portion 326 of the bottom surface 304 of the outer body frame 301 can be angled, curved, beveled, or curvilinear to narrow down the entry area for the magazine from the bottom edge 329 of the bottom surface 302 towards the top surface 302.

The outer perimeter of the outer body frame 301 of the magwell adapter 300 can have any shape, including, but not limited to, round, oval, rectangular, or U-shaped, or substantially U-shaped. In the example of FIGS. 3A-3D, the outer perimeter of the magwell adapter 300 is U-shaped or substantially U-shaped. In one example, the outer frame 301 of the magwell adapter 300 can include a first lateral side 310 and a second lateral side 312. The magwell adapter 300 can also include an inner wall, surface or multiple surfaces 305 that define the opening 328 through the magwell adapter 300 that can extend from the first aperture 361 to the second aperture 363. The magwell adapter 300 can also include a sear spring attachment member 306. In one example, the sear spring attachment member 306 can extend across the opening 328 of the magwell adapter 300. For example, the sear spring attachment member 306 can have a first end coupled to the inner wall 305 along one lateral side 310 of the opening 328 through the magwell adapter 300 and a distal second end coupled to the inner wall 305 along an opposing second lateral side 312 of the opening 328 through the magwell adapter 300. The sear spring attachment member 306 can have planar or substantially planar front and/or rear surfaces and can be configured to be aligned with the sear spring alignment plate 210 when the magwell adapter 300 is coupled to the firearm 200. The sear spring attachment member 306 can be integrally formed with the magwell adapter 300 or separately formed and coupled (e.g., by welding) to the magwell adapter 300.

The sear spring attachment member 306 can include a sear spring aperture 308 that extends from the rear side through to the front side of the sear spring attachment member 306. The sear spring aperture 308 can be a notch, a "bounded slot" (i.e., an elongated slot bounded on all four sides by the sear spring attachment member 306), or an "open-ended slot" (i.e., an elongated slot bounded on less than all four sides by the sear spring attachment member 306). In another alternative embodiment, the sear spring aperture 308 can be an indentation in the rear side of the sear spring attachment member 306 rather than a through-hole.

As shown in FIGS. 3A-3D, in one example embodiment, the sear spring aperture 308 is a notch or open-ended slot disposed along a top end of the sear spring attachment member 306. In this embodiment, the notch or open-ended slot 308 is bounded on three sides of the notch or open ended slot 308 by the sear spring attachment member 306 and is open along the top side of the notch or open-ended slot 308. In this embodiment, when the magwell adapter 300 is coupled to the firearm 200 and the sear spring attachment member 306 aligns with the sear spring alignment plate 210, the bottom end or wall of the sear spring alignment plate 210 can be positioned immediately adjacent the open side of the notch or open-ended slot 308 and can act as the fourth and top wall of the slot 308 to retain a portion of a sear spring therein.

Figure 6:
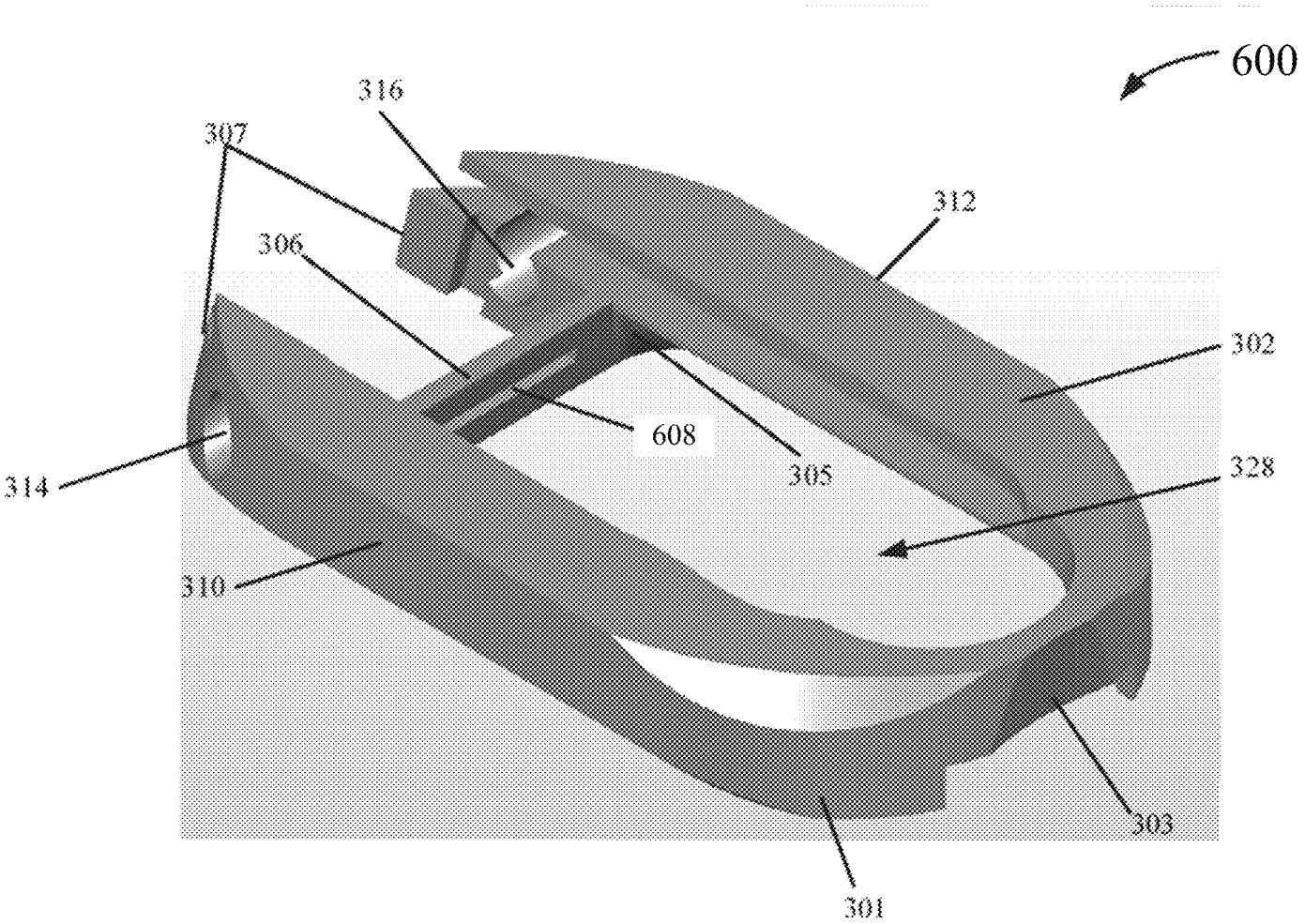
FIG. 6 is a perspective view of a magwell adapter with an alternative sear spring aperture, in accordance with another example embodiment of the disclosure.

In another example embodiment, as shown in FIG. 6, the sear spring attachment member 306 include a sear spring aperture 608 that is a bounded slot. In this example embodiment the sear spring attachment member 306 defines all four walls of the sear spring aperture 608 and can retain a portion of the sear spring therein without assistance from the sear spring alignment plate 210. All other elements of the example magwell adapter 600 of FIG. 6 are the same as that shown and described with reference to the magwell adapter 300 of FIGS. 3A-3D and are incorporated herein by reference into the description of the magwell adapter 600 of FIG. 6.

In one example embodiment, the sear spring aperture 308, 608 is an elongated slot having a width that is substantially greater than the height of the aperture 308, 608. In other example embodiments, the sear spring aperture 308, 608 can be circular, oval, rectangular or any other geometric or non-geometric shape. The sear spring aperture 308, 608 can be configured to receive a portion of a sear spring 500 (see FIG. 5) therein to maintain the position of the sear spring 500 in relation to grip section 207 of the firearm 200.

Figure 5:
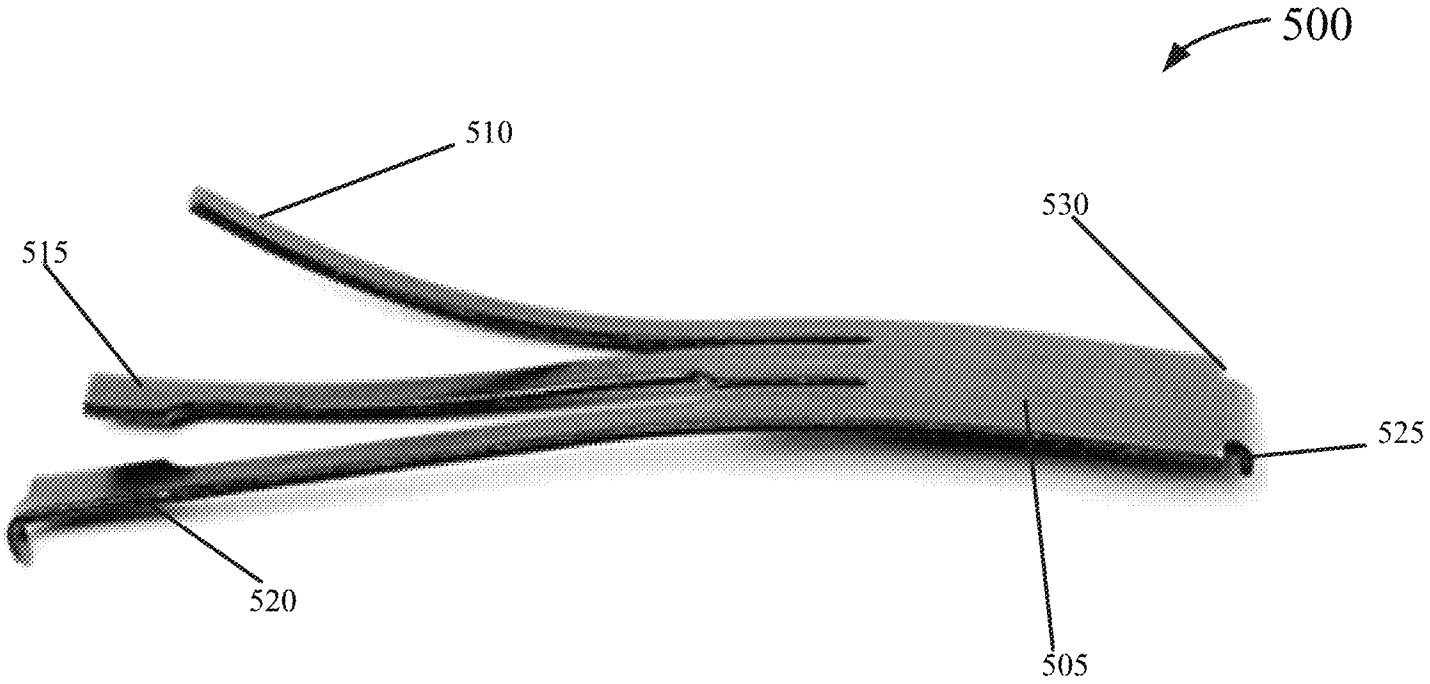
Figure 5 (Prior Art)
FIG. 5 is a side elevation view of a conventional sear spring, in accordance with one example embodiment of the disclosure.

As shown in FIG. 5, the sear spring 500 can include a sear spring member 505 having an attachment end 530 and a distal spring end 535. Multiple springs can extend from the spring end 535 of the sear spring member 505. For example, the springs can include a first spring 510 having a first end coupled to the sear spring member 505 at the spring end 535 and a distal free end. In one example, the first spring 510 can be integrally formed with the sear spring member 505. The first spring 510 can be configured to engage and push the grip safety (or beavertail) out on the firearm 200. The springs can also include a second spring 515 having a first end coupled to the sear spring member 505 at the spring end 535 and a distal free end. In one example, the second spring 515 can be integrally formed with the sear spring member 505. The second spring 515 can be configured to apply pressure on a disconnector of the firearm 200 to press the disconnector up through the frame 205. The springs can also include a third spring 520 having a first end coupled to the sear spring member 505 at the spring end 535 and a distal free end. In one example, the third spring 520 can be integrally formed with the sear spring member 505. The third spring 520 can be configured to reset the sear after the trigger of the firearm 200 is released. In one example, each of the springs can be a leaf spring. The sear spring 500 can also include an attachment tab 525 or hook. The attachment tab 525 or hook can extend from the attachment end 530 of the sear spring member. In one example, the attachment tab 525 is integrally formed with the sear spring member 505 and can be curved such that a free end of the attachment tab 525 extends perpendicular or substantially perpendicular to the longitudinal axis of the sear spring member 505. In one example, the width of the attachment tab 525 is less than the width of the sear spring member 505.

Returning to FIGS. 2A-3D, the magwell adapter 300 can also include a first pin receiving aperture 314 and a second pin receiving aperture 316. The first pin receiving aperture 314 can be a through hole that extends through the first lateral side 310 of the magwell adapter 300 from the outer wall to the inner wall of the first lateral side 310. The second pin receiving aperture 316 can be a through hole that extends through the second lateral side 312 of the magwell adapter 300 from the outer wall to the inner wall of the second lateral side 312. Each of the first pin receiving aperture 314 and second pin receiving aperture 316 can be coaxially aligned and can have the same or substantially the same diameter. In one example, each of the pin receiving apertures 314, 316 can be positioned adjacent to the rear end 307 of the magwell adapter 300 and between the sear spring attachment member 306 and the rear-most edge 307 of the magwell adapter 300. Each of the pin receiving apertures 314, 316 can be configured to receive at least a portion of a main-spring housing pin 410 (see FIG. 4A) therethrough. While the example embodiment of FIGS. 3A-3D describe two pin receiving apertures 314, 316, in other example embodiments the magwell adapter 300 can include a single pin receiving aperture that extends from the first lateral side 310 to the second lateral side 312 of the outer body frame 301. For example, if the rear end 307 of the outer body frame 301 is closed rather than an open end of a U-shape, as shown in FIGS. 3A-3D, a single pin receiving aperture could replace the two pin receiving apertures described above.

The magwell adapter 300 can also include a firearm attachment mechanism 311 configured to be removably coupled to the magwell attachment mechanism 215 of the firearm 200. While one example embodiment of a firearm attachment mechanism 311 will be described herein, that description is not intended to be limiting, as there are a number of firearm attachment mechanisms known in the art for attaching the magwell adapter 300 to the grip section 207, each of which is considered part of this disclosure and able to be used with the concepts described herein. The firearm attachment mechanism 311 can include a first tab 318 disposed along the inner wall 305 of the first lateral side 310 and extending laterally inward therefrom and a second tab 320 disposed along the inner wall 305 along the second lateral side 312 and extending laterally inward therefrom. In certain example embodiments, the first tab 318 can include a first inner wall 334 and the second tab 320 can include a second inner wall 338. The distance between the first inner wall 334 and the second inner wall 338 can be constant or substantially constant for all or a substantial portion of the first inner wall 334 and the second inner wall 338. The first tab 318 can also include a first fitment surface 336 or inwardly projecting protrusion that extends inwardly from the first inner wall 334 towards the second inner wall 338 and reduces the distance between the first inner wall 334, at the fitment surface 336, and the second inner wall 338. In addition the second tab 320 can also include a second fitment surface 340 or inwardly projecting protrusion that extends inwardly from the second inner wall 338 towards the first inner wall 334 and reduces the distance between the second inner wall 338, at the second fitment surface 340, and the first inner wall 334. In one example, the first fitment surface 336 and the second fitment surface 340 are axially aligned along the magwell adapter 300. The reduction in distance between the first inner wall 334 and the second inner wall 338 at the first 338 and second 340 fitment surfaces can increase a friction fit between the magwell adapter 300 and the grip section 207 to maintain the coupling between the magwell adapter 300 and the grip section 207 of the firearm 200.

The firearm attachment mechanism 311 can also include a first slot 322 disposed along and into the inner wall 305 of the first lateral side 310 and extending laterally outward therefrom. The first slot 322 can be positioned directly below the first tab 318. The firearm attachment mechanism 311 can also include a second slot 324 disposed along and into the inner wall 305 of the second lateral side 312 and extending laterally outward therefrom. The second slot 324 can be positioned directly below the second tab 320. Each of the first tab 318, first slot 322, second tab 320, and second slot 324 can extend from the rear edge 307 or substantially the rear edge 307 of the magwell adapter 300 towards the front side 303 of the magwell adapter 300. In one example, the first tab 318 and the second tab 320 can be a single unitary tab that extends from the first lateral side 310 to the second lateral side 312 of the magwell adapter 300. Similarly, in one example embodiment, the first slot 322 and second slot 324 can be a single unitary slot that extends from the first lateral side 310 to the second lateral side 312.

In one example, when the magwell adapter 300 is attached to the firearm 200 via the firearm attachment mechanism 311 and the magwell attachment mechanism 215, the first tab 318 of the firearm attachment mechanism 311 can be inserted into the first slot 230 of the magwell attachment mechanism 215, the first tab 220 of the magwell attachment mechanism 215 can be inserted into the first slot 322 of the firearm attachment mechanism 311, the second tab 320 of the firearm attachment mechanism 311 can be inserted into the second slot 235 of the magwell attachment mechanism 215, and the second tab 225 of the magwell attachment mechanism 215 can be inserted into the second slot 324 of the firearm attachment mechanism 311 to removably couple the magwell adapter 300 to the grip section 207 of the firearm 200.

Figure 4A:
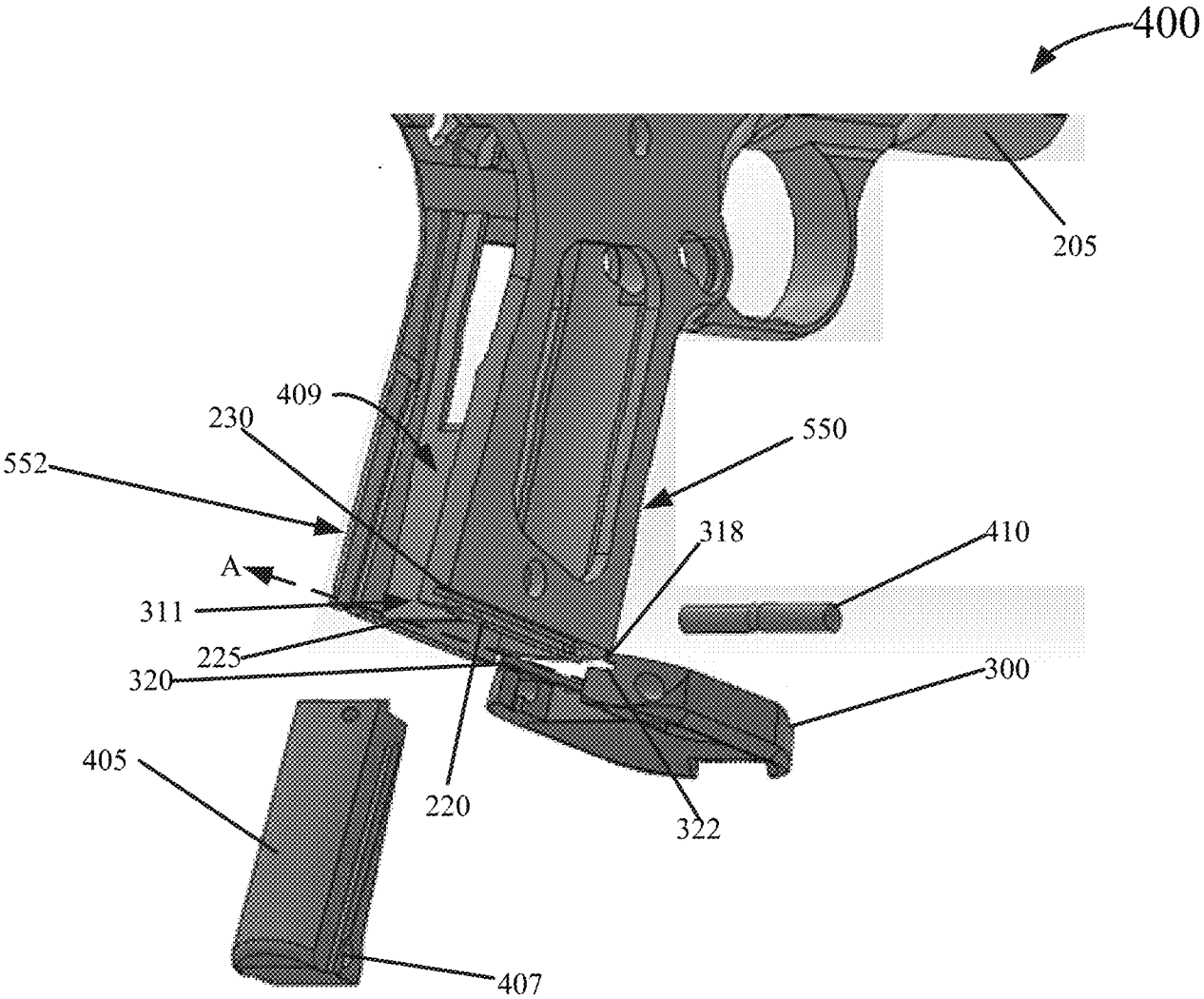
FIGS. 4A-4G are various views presenting a method for attaching the magwell adapter and sear spring to the firearm frame, in accordance with one example embodiment of the disclosure.
Figure 4B:
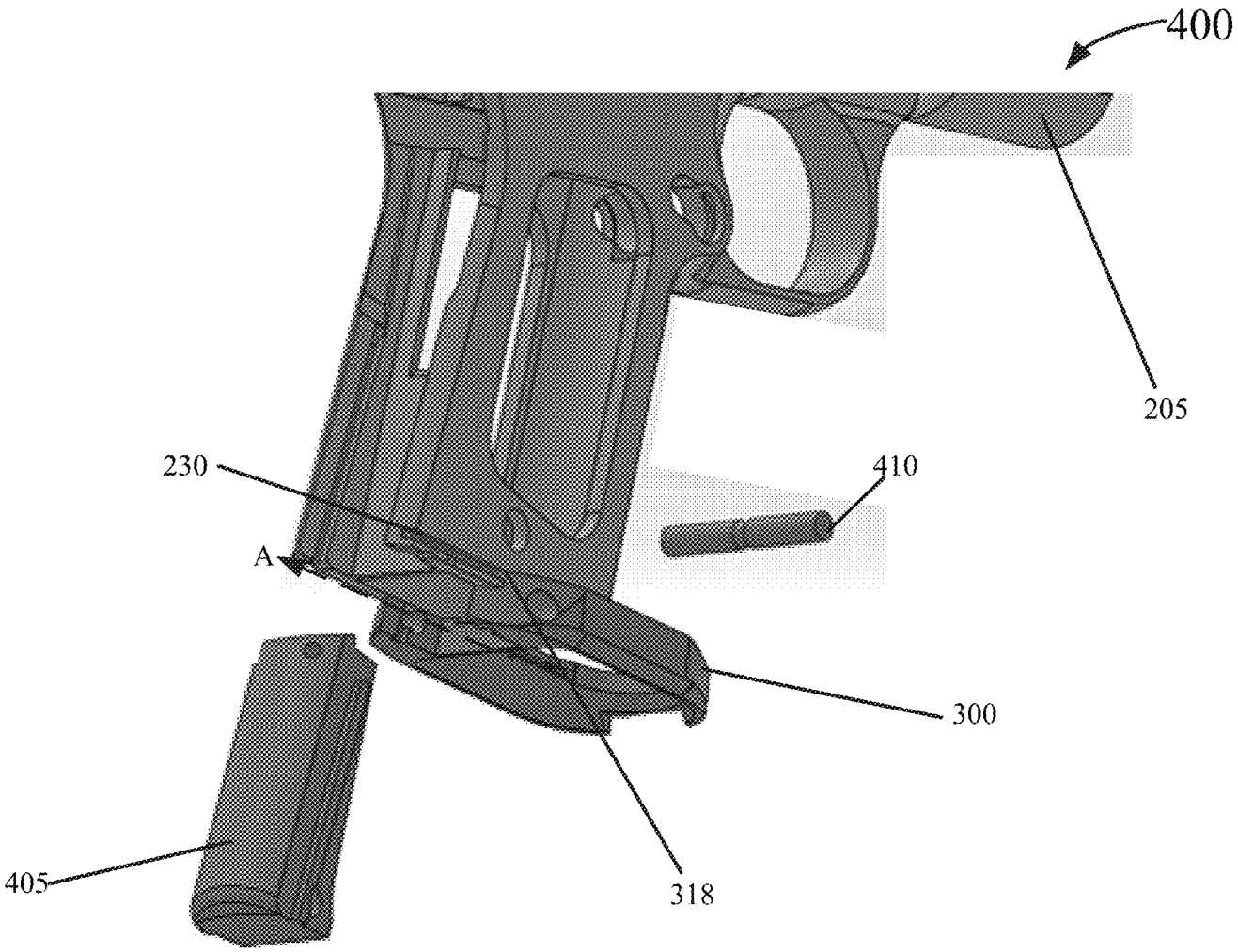
Figure 4C:
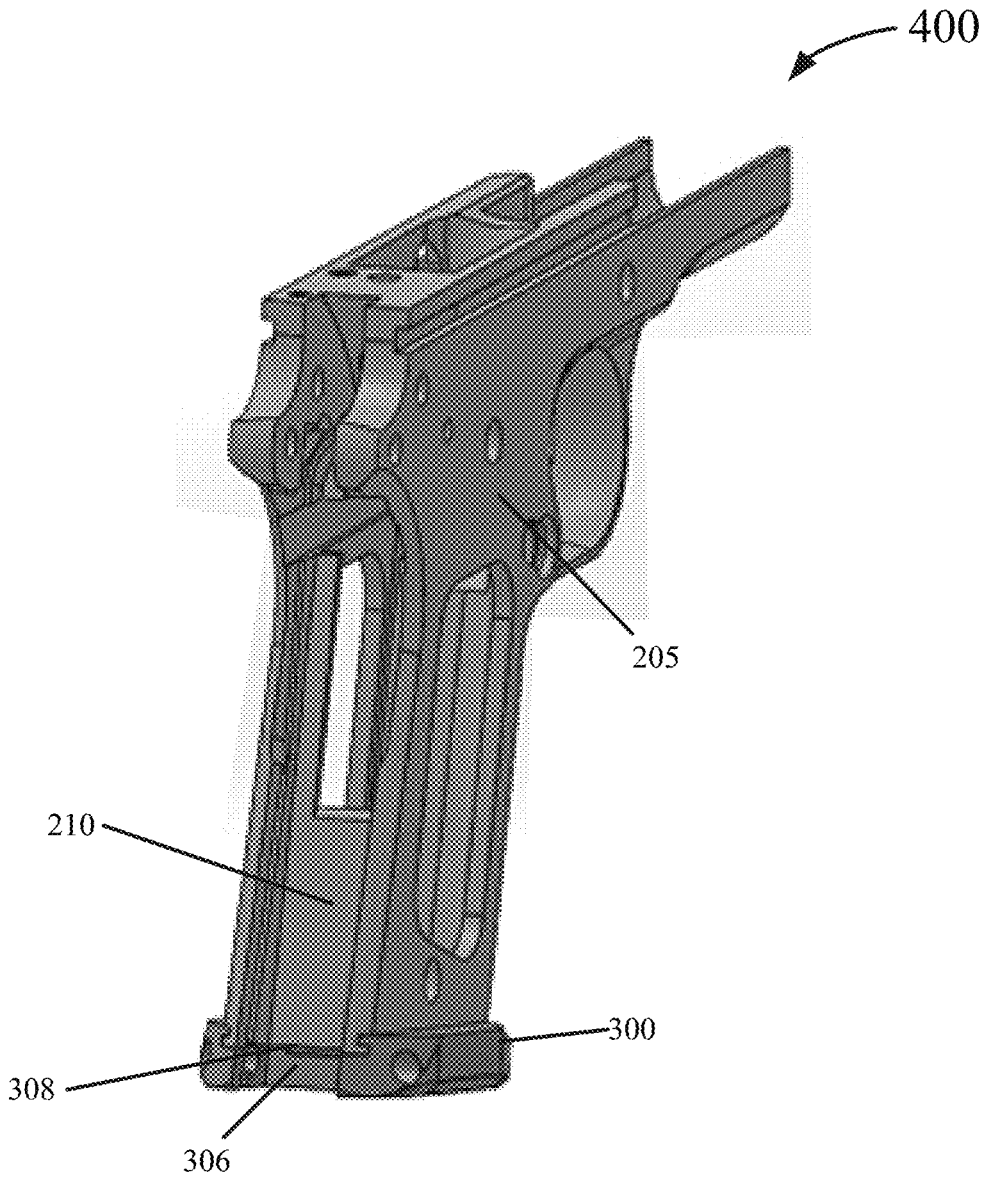

FIGS. 4A-4G are various views presenting a method 400 for attaching the magwell adapter 300, sear spring 500, and main spring housing 405 to the firearm frame 205, in accordance with one example embodiment of the disclosure. Now referring to FIGS. 2A-5, the example method 400 can begin with removably coupling the magwell adapter 300 to the grip section 207 of the firearm frame 205. In one example, the magwell adapter 300 can be slidably coupled to the magwell attachment mechanism 215 at the bottom end of the grip section 207 from the front side 550 of the bottom end of the grip section 207 towards the rear side 552 of the bottom end of the grip section 207. For example, the tab 318 of the magwell adapter 300 can be aligned with and inserted into the slot 230 of the magwell attachment mechanism 215 along the front side 550, the tab 320 of the magwell adapter 300 can be aligned with and inserted into the slot 235 of the magwell attachment mechanism 215 along the front side 550, the tab 220 of the magwell attachment mechanism 215 can be aligned with and inserted into the slot 322 of the magwell adapter 300, and the tab 225 of the magwell attachment mechanism 215 can be aligned with and inserted into the slot 324 of the magwell adapter 300. The magwell adapter 300 can then be moved in the direction A from the front side 550 of the grip section 207 towards the rear side 552 of the grip section 207 (or the firearm frame 205 can be moved in the direction opposite A) to slidably couple the magwell adapter 300 to the firearm frame 205, as best shown in FIGS. 4A-4B. In an alternative embodiment, the magwell adapter 300 can be slidably coupled to the magwell attachment mechanism 215 in substantially the same way as described above by sliding the magwell adapter 300 in the direction opposite A from the rear side 552 of the grip section 207 towards the front side 550 of the grip section 207.

Figure 4D:
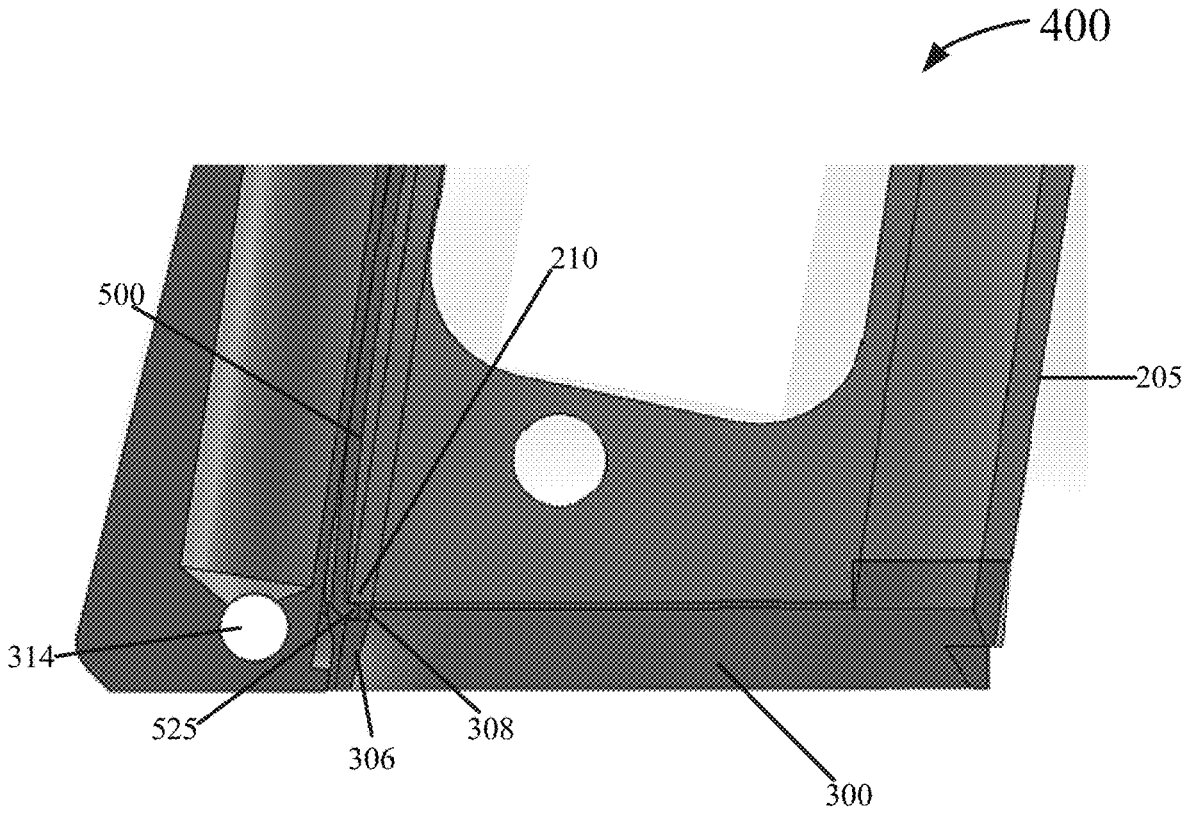
Figure 4E:
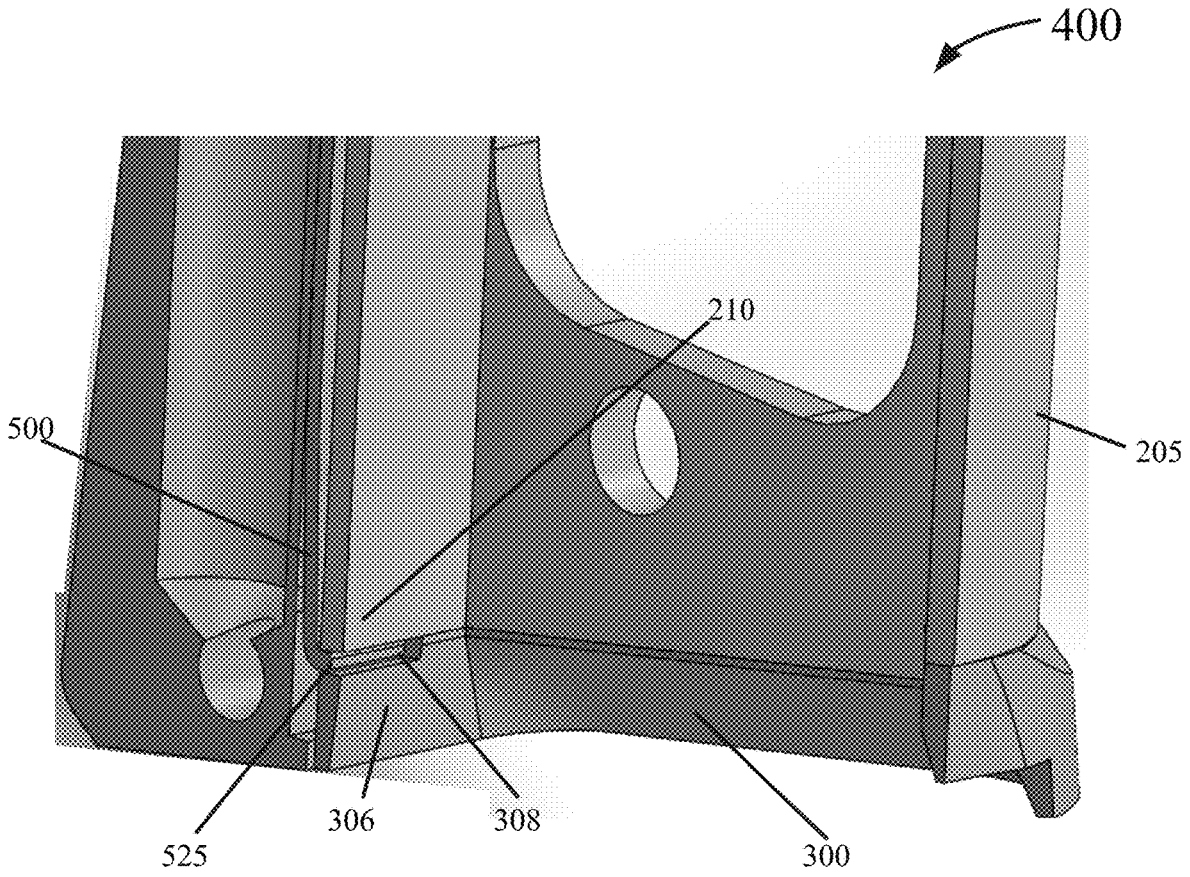
Figure 4F:
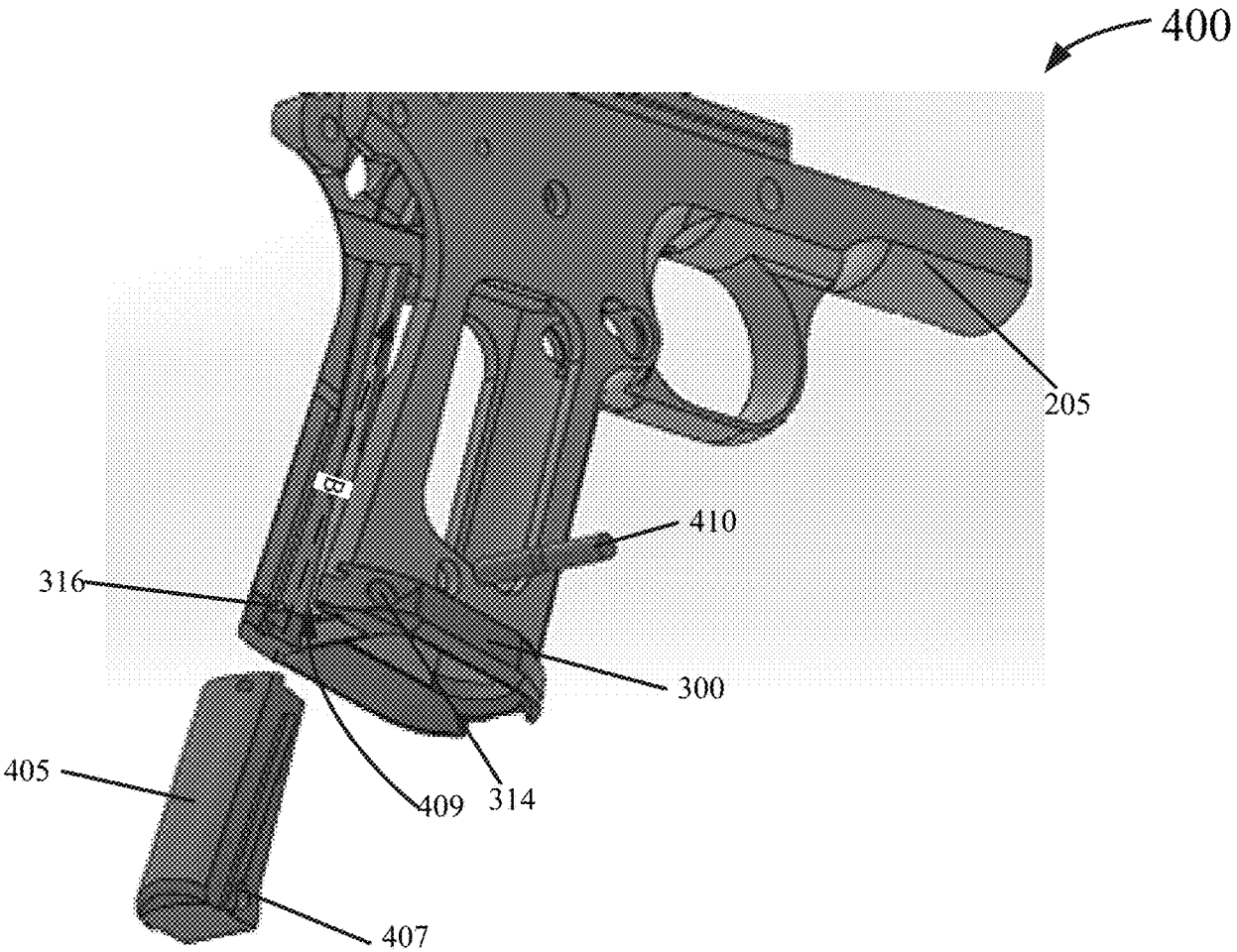

The method 400 can further include removably coupling the sear spring 500 to the magwell adapter 300. For example, the attachment tab 525 can be inserted into the sear spring aperture 308, 608 to removably couple the sear spring 500 to the magwell adapter 300 and or the combination of the magwell adapter and the sear spring alignment plate 210, as best shown in FIGS. 4D-4E. In certain example embodiments, at least a portion of the sear spring 500 can abut or be disposed adjacent to but is not coupled to the sear spring alignment plate 210 of the firearm frame. The springs 510-520 can then interact with additional components of the firearm 200 as discussed above.

The method 400 can also include removably coupling a main spring housing 405 to the magwell adapter 300 and the firearm frame 205. The main spring housing 405 can include a pin receiving aperture 407 that can extend from one lateral side of to the opposing lateral side of the main spring housing 405. In one example, the pin receiving aperture 407 can be generally positioned near a bottom end of the main spring housing 405. The main spring housing 405 can be slidably inserted in the direction B into a cavity 409 disposed along a back side of the grip section 207. In one example, the main spring housing 405 and one or more of the walls of the cavity 409 can include tabs and/or slots to slidably insert and properly align the main spring housing 405 into the cavity 409.

Figure 4G:
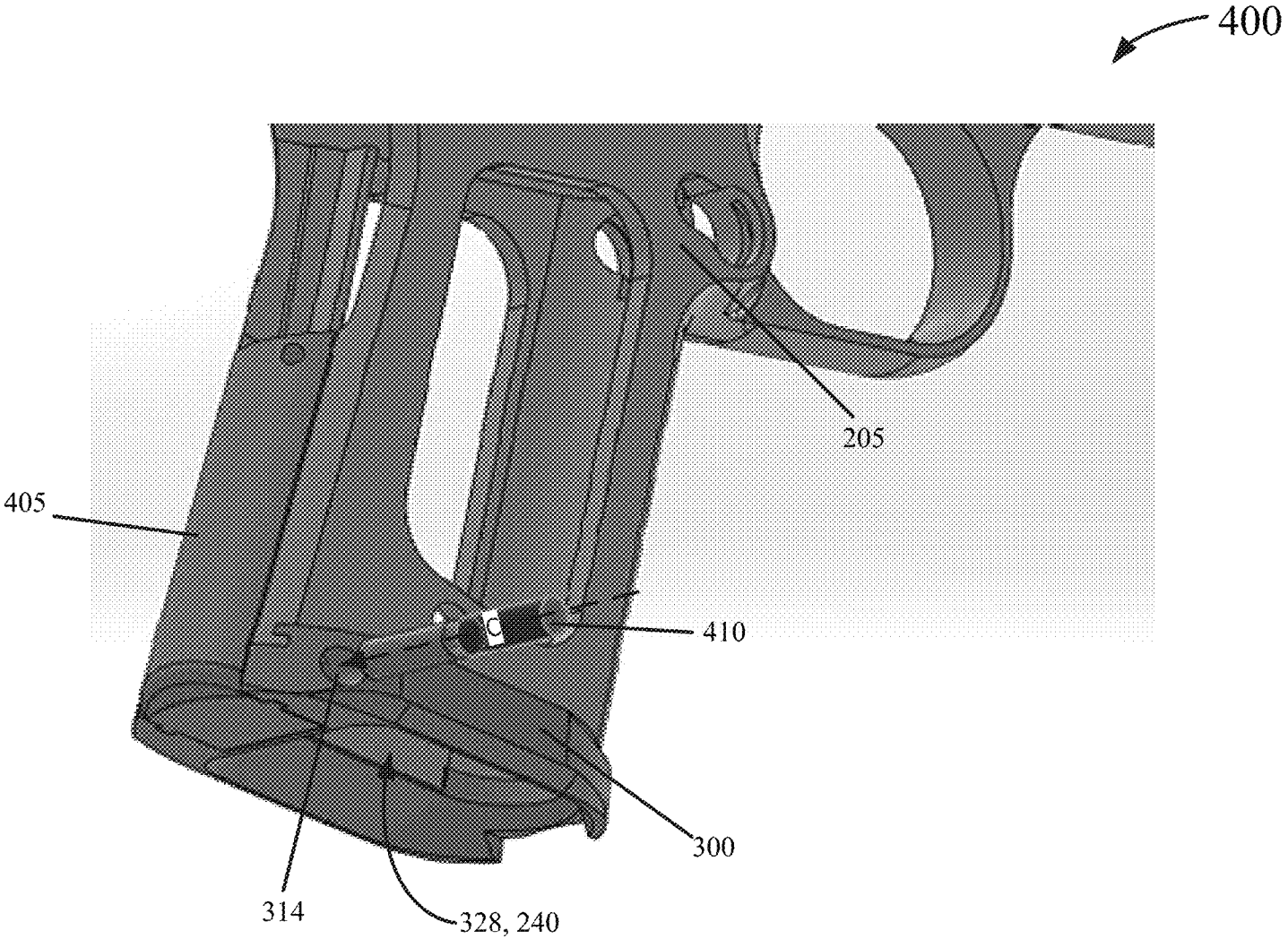

The main spring housing 405 can be slidably inserted into the cavity 409 until the pin aperture 407 is aligned (e.g., coaxial with) the pin receiving apertures 314, 316 on the magwell adapter 300. The main spring housing 405 can then be removably coupled to the magwell adapter 300 by inserting, in the direction C, a main spring housing pin 410 into the pin receiving aperture 314, the spring aperture 407 and the pin receiving aperture 316 (or in the direction opposite C into the pin receiving aperture 316, the spring aperture 407, and the pin receiving aperture 314), as shown in FIG. 4G. In this example, the main spring housing pin 410 is not inserted through any apertures in the firearm frame 205, such as through apertures in the grip section 207. As such, a pin does not couple the main spring housing 405 to the firearm frame 205, as is done in conventional firearms. Instead, the main spring housing pin 410 maintains the main spring housing 405 within the cavity 409 of the grip section 207 by coupling the main spring housing 405 to the magwell adapter 300, 600, which is itself removably coupled to the firearm frame 205.

In yet another example embodiment, a magwell adapter can be provided that is substantially the same as that shown and described with reference to the magwell adapter 300 of FIGS. 3A-3D and the magwell adapter 600 of FIG. 6 except as set forth below. This alternative embodiment of the magwell adapter may be used for firearms that have a long enough grip section such that the grip section already includes a sear spring attachment slot. In this alternate embodiment, the magwell adapter may not include the sear spring aperture and/or the sear spring attachment member. In other examples, the magwell adapter may include the sear spring aperture and/or the sear spring attachment member but it just might not be used for attaching the sear spring to the firearm. This alternative embodiment of the magwell adapter would still include the firearm attachment mechanism in substantially the same form as that described with reference to the firearm attachment mechanism 311 of FIG. 3A-3D, including features substantially the same as the first tab 318, second tab 320, first slot 322, and second slot 324 to provide a way to slidably attach the alternative magwell adapter to the bottom end of the grip section of the firearm in the same manner as that shown and described in FIGS. 4A-4C. The user just would not insert the attachment tab 525 of the sear spring 500 to a slot in the magwell adapter. The attachment tab 525 would instead be conventionally attached to the attachment slot 115 already provided in the sear spring alignment plate 110 of the firearm. This alternative magwell adapter would provide a quick, easy, and convenient way for attaching and detaching the magwell adapter to and from a number of different types of firearms, including, but not limited to, a 1911 45 caliber government model firearm.

Though the disclosed example includes a particular arrangement of a number of parts, components, features, and aspects, the disclosure is not limited to only that example or arrangement. Any one or more of the parts, components, features, and aspects of the disclosure can be employed alone or in other arrangements of any two or more of the same.

Although certain firearm and magwell adapter features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A magwell adapter for a firearm having a grip section, comprising:

an outer body frame configured to removably couple with a mainspring housing of the firearm; and a sear spring attachment member coupled to the outer body frame and comprising a sear spring aperture configured to receive an attachment tab of a sear spring, wherein the magwell adapter is configured to be removably coupled to a grip section of a firearm.

2. The magwell adapter of claim 1, wherein the outer body frame comprises:

a first lateral side comprising a first outer wall and at least one first inner wall; and a second lateral side comprising a second outer wall and at least one second inner wall, wherein the sear spring attachment member comprises a first end coupled to at least one of the at least one first inner wall and a distal second end coupled to at least one of the at least one second inner wall.

3. The magwell adapter of claim 2, further comprising a firearm attachment assembly.

4. The magwell adapter of claim 3, wherein the firearm attachment assembly comprises:

at least one tab disposed along at least one of the at least one first inner wall and the at least one second inner wall and extending radially inward; and at least one slot disposed in at least one of the at least one first inner wall and the at least one second inner wall and extending radially outward.

5. The magwell adapter of claim 1, wherein the sear spring aperture is disposed through the sear spring attachment member and is one of a notch, a bounded slot, or an open-ended slot.

6. The magwell adapter of claim 1, wherein the sear spring aperture is a notch in the sear spring attachment member along a top side of the sear spring attachment member.

7. The magwell adapter of claim 1, wherein the sear spring aperture is a cavity extending into a portion of the sear spring attachment member.

8. The magwell adapter of claim 1 further comprising:

a first pin receiving aperture; and a second pin receiving aperture coaxially aligned with the first pin receiving aperture.

9. The magwell adapter of claim 8, wherein the outer body frame comprises a front end and an opposing rear end, wherein each of the first pin receiving aperture and the second pin receiving aperture a disposed between the rear end and the sear spring attachment member.

10. The magwell adapter of claim 1, wherein the outer body frame comprises:

a top surface comprising an inner edge defining a first opening in the outer body frame having a first surface area; and an opposing bottom surface comprising a second inner edge defining a second opening in the outer body frame having a second surface area, wherein the first opening and the second opening second are fluidicly coupled and wherein the second surface area is greater than the first surface area.

11. An apparatus comprising:

a firearm comprising:

a firearm frame comprising:

a barrel section; and a grip section comprising:

a sear spring alignment plate;

a magazine well disposed in portion of the grip section along a first side of the sear spring alignment plate; and a main spring cavity disposed along a second side of the sear spring alignment plate;

a magwell adapter removably coupled to the grip section;

a sear spring removably coupled to the magwell adapter and abutting at least a portion of the sear spring alignment plate; and a main spring housing slidably inserted into the main spring cavity and removably coupled to the magwell adapter, wherein the magwell adapter comprises a sear spring attachment member, the sear spring attachment member comprising a sear spring aperture configured to receive an attachment tab of the sear spring.

12. The apparatus of claim 11, wherein the magwell adapter comprises at least one pin receiving aperture, wherein the main spring housing comprises a second pin receiving aperture, and wherein the system further comprises a mainspring housing pin extending into the at least one pin receiving aperture and the second pin receiving aperture to couple the main spring housing to the magwell adapter.

13. The apparatus of claim 11, wherein the sear spring comprises an attachment tab and wherein the attachment tab is inserted into the sear spring aperture to couple the sear spring to the magwell adapter.

14. The apparatus of claim 13, wherein the sear spring aperture is disposed through the sear spring attachment member and is one of a notch, a bounded slot, or an open-ended slot.

15. The apparatus of claim 13, wherein the sear spring aperture is a notch in the sear spring attachment member along a top side of the sear spring attachment member.

16. The system of claim 15, wherein the sear spring attachment member defines a bottom side, a first lateral side, and a second lateral side for the notch, wherein the sear spring attachment member is aligned with the sear spring alignment plate when the magwell adapter is coupled to the grip section and wherein a portion of the sear spring alignment plate defines a top side for the notch to maintain the sear spring within the sear spring aperture.

* * * * *